US005775938A

United States Patent [19]

Noro et al.

[11] Patent Number: 5,775,938

[45] Date of Patent: Jul. 7, 1998

[54] CONNECTOR FOR FLAT CABLES

[75] Inventors: Yutaka Noro; Hideto Nakamura; Masamitsu Chishima, all of Yokkaichi, Japan

[73] Assignee: Sumitomo Wiring Systems, Ltd., Japan

[21] Appl. No.: 767,955

[22] Filed: Dec. 19, 1996

[30] Foreign Application Priority Data

Dec. 19, 1995 [JP] Japan ..... 7-330375

[51] Int. Cl.[6] ..... H01R 9/07

[52] U.S. Cl. ..... 439/495

[58] Field of Search ..... 439/495, 496, 439/266, 267

[56] References Cited

U.S. PATENT DOCUMENTS 5,106,311 4/1992 Yodagawa et al. ..... 439/495

FOREIGN PATENT DOCUMENTS 0519317 12/1992 European Pat. Off. .
0667651 8/1995 European Pat. Off. .
4206374 7/1992 Japan .

*Primary Examiner*—Gary F. Paumen
*Attorney, Agent, or Firm*—Jordan B. Bierman; Bierman, Muserlian and Lucas

[57] ABSTRACT

A connector for a flat cable having a hollow casing with a cavity therein. The cavity receives a leading end of the flat cable through a front opening in the casing. The cable has a plurality of flat terminals on both sides of the leading end. Complementary front and rear terminals are inserted into the cavity from front and rear openings in the casing. Each set of terminals contacts one side of the leading end of the cable. The leads from each set of terminals extend outwardly of the casing in opposite directions, thereby reducing the density of leads and facilitating assembly thereof.

17 Claims, 4 Drawing Sheets

CONNECTOR FOR FLAT CABLES

This Application claims the benefit of the priority of Japanese Application 7-330375, filed Dec. 19, 1995.

The present Invention is directed to a connector for flat cables; more specifically, to a connector adapted for use with flat cables which have terminals on both faces thereof.

BACKGROUND OF THE INVENTION

Previously known connectors for flat cables are exemplified by Japanese OPI 4/206374. As shown in FIGS. 10 and 11, flat cable 1 carries terminals 2 on both faces of its end. Cable connector 3 is provided with slit 4 into which terminals 2 are inserted. As shown particularly in FIG. 11, cable 1, after passing through slit 4, is located between connecting terminals 5. Terminals 5 extend out of the front of connector 3 and are adapted to be connected to other terminals (not shown).

As can be seen in FIG. 10, terminals 5 are arranged in two, spaced apart rows, complementary to terminals 2. Each row contacts terminals 2 on one face of flat cable 1. The terminals are biased toward each other so that, when terminals 2 are inserted therebetween, good electrical contact is made.

This construction suffers from a serious disadvantage. Due to the large number of terminals 5 which extend from the front surface of cable connector 3, wiring is extremely difficult. Moreover, the opportunities for error are increased because there is not much room between adjacent terminals.

SUMMARY OF THE INVENTION

It is an object of the present Invention to provide a cable connector for flat cables wherein the density of the terminals is substantially reduced, even though the total number of such terminals remains the same. Moreover, the present Invention does not materially increase the size of the connector.

The inventive connector is provided with a hollow casing having a cavity therein. The cavity extends from a front opening in the casing to a rear opening remote therefrom. The front opening is a slit which is complementary to the leading end of the flat cable. The cable is provided with a plurality of flat terminals adjacent the leading end and on both sides thereof. The casing contains a similar plurality of front terminals, corresponding to the flat terminals. The front terminals are inserted through the front opening into the cavity and are adapted to contact the flat terminals on one side of the leading end.

The casing also contains a plurality of rear terminals, corresponding to the flat terminals, which have been inserted through the rear opening into the cavity. These terminals are adapted to contact the flat terminals on the other side of the leading end. The spacing between the front and rear terminals is preferably smaller than the thickness of the leading end. Thus, when the cable is passed through the slit between the front and rear terminals, good electrical contact is made therewith.

The present Invention provides a plurality of front leads, each of which is in electrical contact with one of the front terminals and extends through the front opening and out of the casing. Similarly, there is provided a plurality of rear leads, each in electrical contact with one of the rear terminals and extending out of the casing through the rear opening.

To insure good electrical contact between the front and rear terminals on the one hand and the two sets of flat terminals on the other, it is advisable that the front and rear terminals be biased toward one another. Therefore, if the flat cable is inserted, a certain amount of pressure is required to force the front and rear terminals apart; this has a tendency to cause abrasion, particularly of the flat terminals.

In order to overcome this difficulty, a retainer, carrying a planar plate which is generally parallel to the planes of all of the terminals, is provided. The plate can be introduced into the cavity to deflect the front or rear terminals and thereby increase the separation between them. This permits introduction of the flat cable without risk of abrasion or damage.

In a desirable form of the Invention, the plate is provided with a plurality of grooves extending completely therethrough. The grooves correspond to either the front terminals or the rear terminals and extend longitudinally toward—but terminate short of—the distal end of the plate.

Thus, as the distal end of the plate is inserted through the front opening, it contacts either the front terminals or the rear terminals. The pressure thereof deflects one set of the terminals so as to increase its separation from the other set. At this point, with the retainer in this initial position, the flat cable can easily be inserted without contacting either the front or rear terminals. Thereafter, the plate is moved from the initial position further into the cavity to an operative position. In the latter, the terminal contacted by the distal end rides thereover and, due to its resilience, passes through the groove so that it is at or adjacent the other terminal, thereby providing good electrical contact between the front terminals and the flat terminals, as well as between the flat terminals and the rear terminals.

To secure the front terminal in the casing, a front fixing hole is provided. A front positioning piece is affixed to or integral with the front terminal. Analogously, a rear fixing hole is provided which can receive a rear positioning piece affixed to or integral with the rear terminals. Thus, the insertion of the positioning pieces of the front and rear terminals secures them in the casing.

As further refinements of the present Invention, the front or rear terminal being deflected by the plate carries an inclined entry face against which the distal end presses. This assists in causing the deflection of the terminal. This face inclines upwardly in the entry direction of the plate. The terminal also has an inclined withdrawal face which angles downwardly in the aforementioned entry direction. Thus, on insertion, the distal end first rides up the entry face (thereby separating the terminals) and then rides down the withdrawal face, permitting the terminal to pass through the groove and approach the other terminal. When the plate is withdrawn, the action between the distal end and the inclined faces is the reverse of that described above.

It has been found advantageous to modify the retainer by providing a base to which the plate is attached. The base has a configuration corresponding to the front opening so that, when the plate is in its operating position, the base covers the front opening and prevents entry of undesired contaminants.

In another embodiment of the Invention, the retainer has a flat surface and a wall depending from the trailing edge thereof. A lip extends from the depending wall in a direction toward the leading edge of the retainer and is spaced apart from the flat surface, thereby providing a U-shaped cross section. The distal edge of the lip contacts and deflects the rear contact when the edge is fully inserted into the cavity. Preferably, there are inclined mating surfaces which facilitate the movement of the rear terminal away from the front terminal. In this position, the flat cable is readily inserted without risk of damage. Thereafter, the retainer is moved to an operative position wherein the lip releases the rear terminal which is biased toward the front terminal. As a result, the flat terminals on the leading end of the cable are firmly contacted by the front and rear terminals, thus insuring a good electrical connection.

It has also been found useful to provide the base with a pair of spaced apart arms which are adapted to slide in complementary guide grooves on the walls of the casing. In addition, projections and detents can also be provided whereby the retainer is releasably locked in the desired operative position.

BRIEF DESCRIPTION OF THE DRAWINGS

In the accompanying drawings, constituting a part hereof and in which like reference characters indicate like parts.

DESCRIPTION OF THE PREFERRED EMBODIMENT(S)

Figure 1:
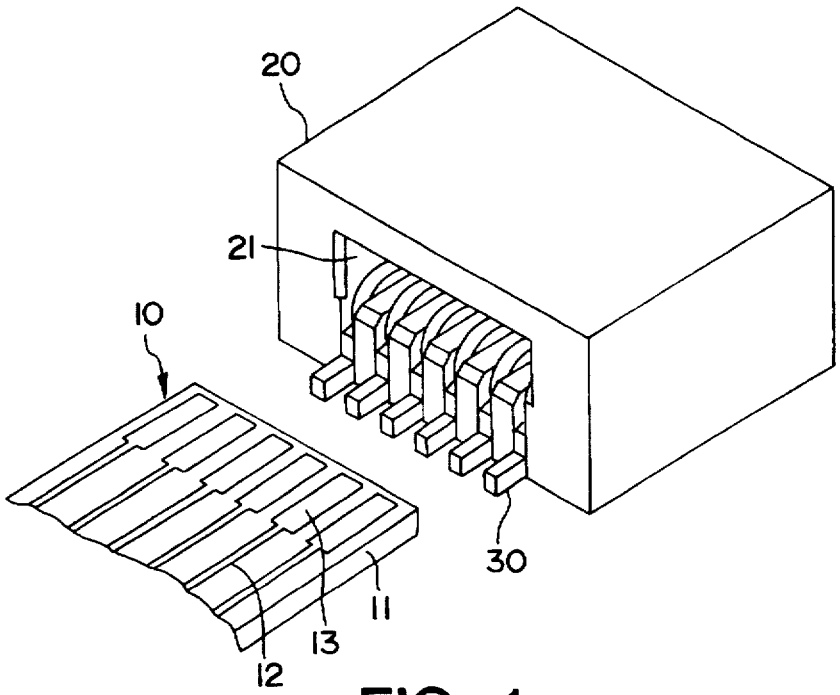
FIG. 1 is a front perspective view of one embodiment of the present Invention.
Figure 2:
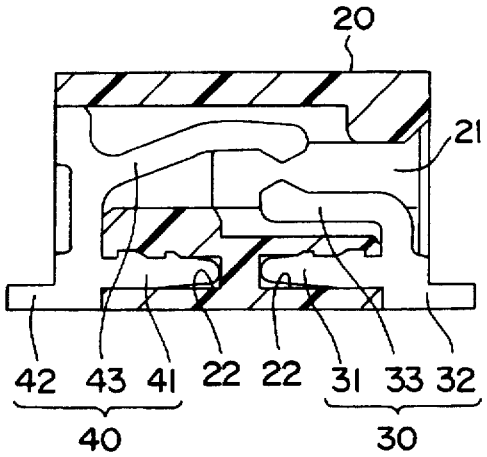
FIG. 2 is a longitudinal partial cross section of the connector of FIG. 1 with no flat cable inserted.
Figure 3:
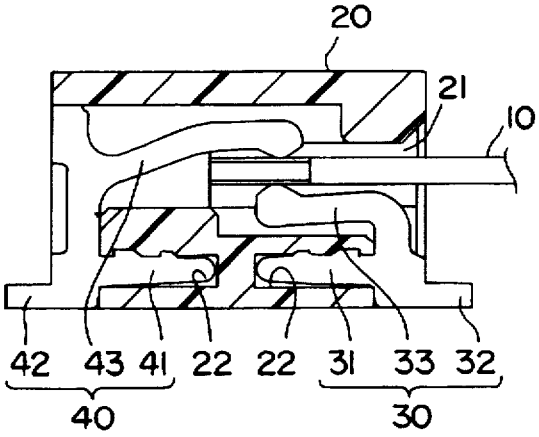
FIG. 3 is a view similar to that of FIG. 2 with the flat cable inserted.

Referring to FIGS. 1 to 3, the connector of the present Invention comprises casing 20 having slit 21 on the front thereof. Flat cable 10 consists of film 11 and carries circuits 12 ending in flat terminals 13. Front terminals 30 correspond in number and location to flat terminals 13 on one side of cable 10. Circuits 12 and terminals 13 can be formed in any known manner; e.g. circuits 12 can be placed on one side only of film 11 and the end thereof folded over so that terminals 13 are on both sides.

The end of cable 10 can be made of stiffer or stronger material than the remainder thereof, a protective cap may be placed thereon which will leave only terminals 13 exposed, etc. There is no requirement that the end be flexible; for the purposes of the present Invention, the end need only have terminals 13 on both sides.

Front terminals 30 consist of front lead 32, front contact 33, and positioning piece 31. Analogously, rear terminals 40 are made up of rear lead 42, rear contact 43, and positioning piece 41. Positioning pieces 31 and 41 fit into fixing holes 22 as shown in FIGS. 2 and 3. The distance between the distal ends of contacts 33 and 43 is preferably somewhat shorter than the thickness of cable 10.

Referring more specifically to FIG. 3, cable 10 is inserted through front opening 21 into the cavity in casing 20. The flat terminals on either side of cable 10 are contacted by front contact 33 and rear contact 43, thus completing circuits 12. Loads 32 and 42, which extend out of casing 20, are used to make electrical connections to other circuitry, such as that to be found on a circuit board. It is a feature of the present Invention that leads 32 and 42 are not concentrated on one surface of casing 20, but rather extend both forwardly (leads 32) and rearwardly (leads 42). By decreasing the concentration of the leads, wiring and connection are made simpler and less prone to error.

Figure 4:
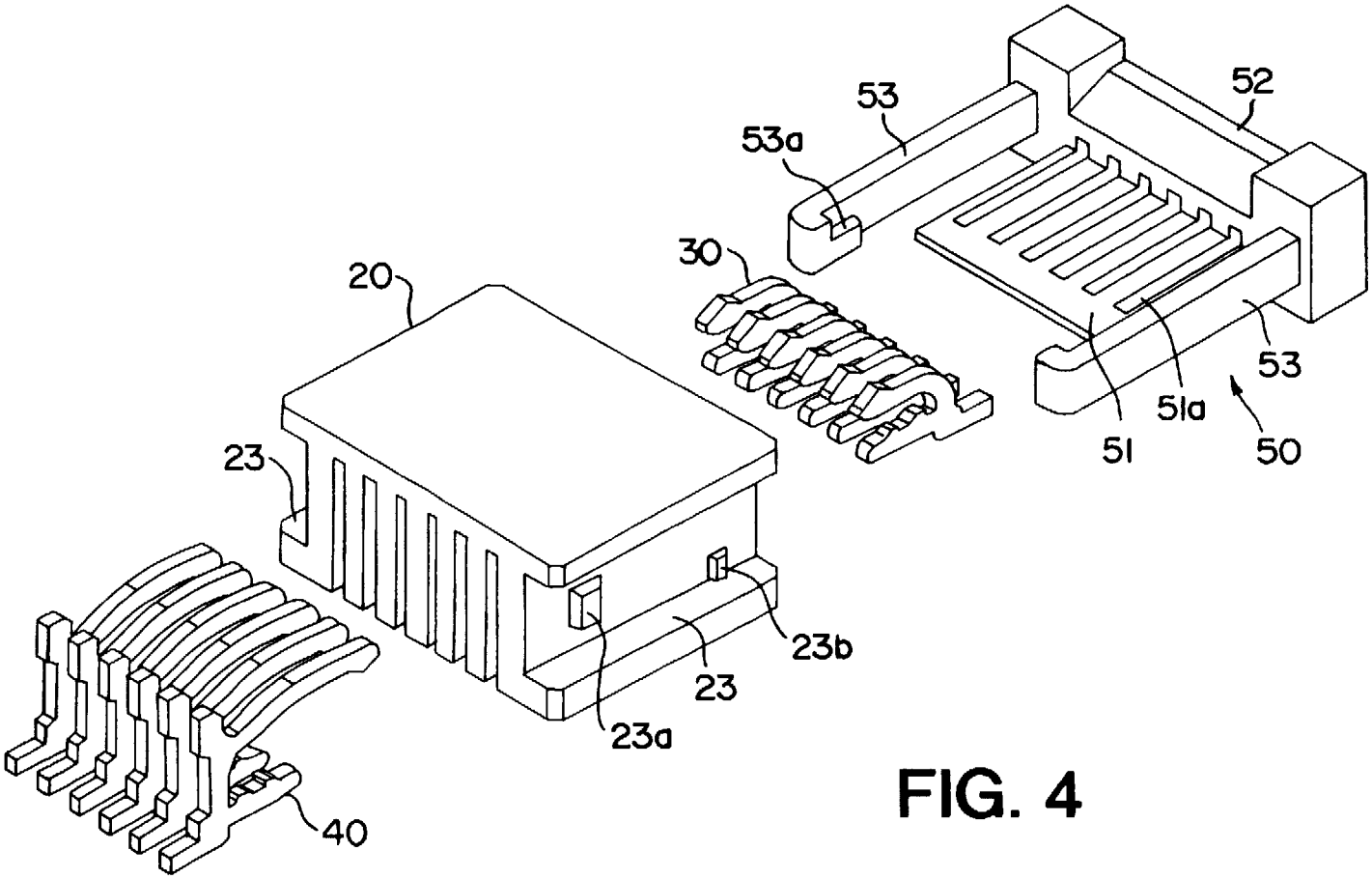
FIG. 4 is an exploded perspective view of another embodiment of the present Invention.
Figure 5:
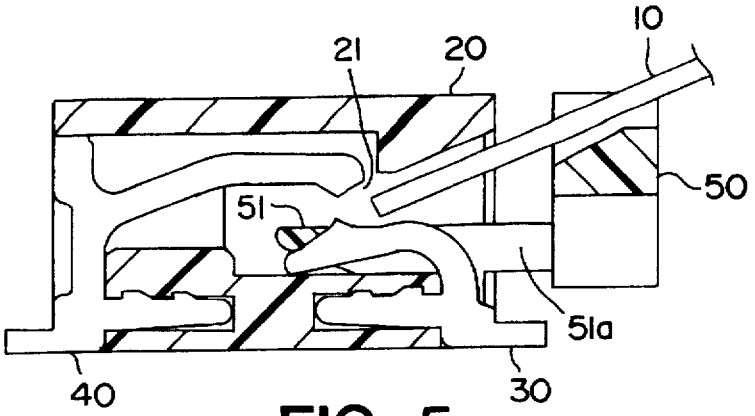
FIG. 5 is a longitudinal partial cross section of the connector of FIG. 4 with the flat cable partially inserted.
Figure 6:
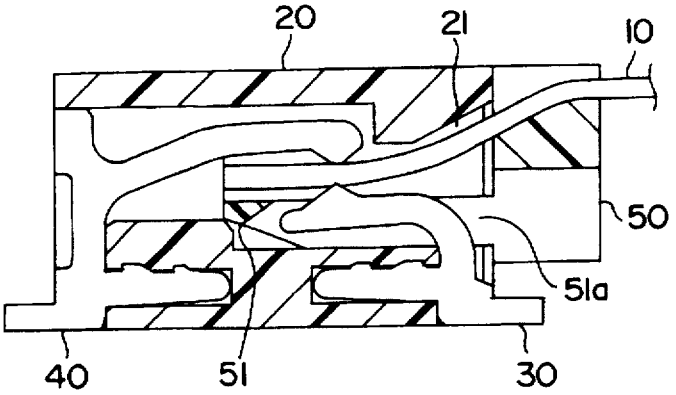
FIG. 6 is a view similar to that of FIG. 5 wherein the flat cable is fully inserted.

Another embodiment of the present Invention is shown in FIGS. 4 to 6. In this modification, retainer 50 is comprised of base 52 and arms 53 which have projections **53*a* at their distal ends. Complementary guide grooves 23 are located on the sides of casing 20 and are provided with projections 23*a* and 23*b*. As retainer 50 is slid onto casing 20, arms 53 move in guide grooves 23 and projection 23*b* cooperates with projection 53*a* to hold retainer 50 in its initial position. When retainer 50 is fully mounted on casing 20, projections 23*a* engage projections 53*a*, thereby securing retainer 50 in its operative position. Retainer 50 carries plate 51 which contains grooves 51*a* extending therethrough. Grooves 51*a* terminate short of the distal edge of plate 51**.

Retainer 50 is mounted on casing 20 in its initial position; the distal edge of plate 51 bears against the upwardly slanted surface of front terminal 30, thus deflecting it downward (as shown in FIG. 5) and separating front terminal 30 from rear terminal 40 by a distance which is preferably greater than the thickness of flat cable 10.

Cable 10 is then inserted all the way into the cavity in casing 20. This can be done easily, since terminals 30 and 40 are sufficiently separated so that no pressure is exerted on the end of cable 10. Thereafter, as shown in FIG. 6, retainer 50 is fully inserted into its operative position. As the distal edge of plate 51 passes beyond the distal end of front terminal 30, the latter is released and passes through grooves **51*a* to bear against cable 10. As a result, cable 10 is firmly held in casing 20 and good electrical contact between terminals 30 and 40 and the flat terminals on the end of cable 10** is maintained.

Figure 7:
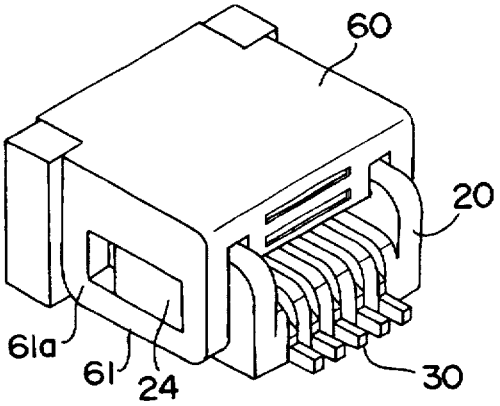
FIG. 7 is a perspective view of a third embodiment of the present Invention.
Figure 8:
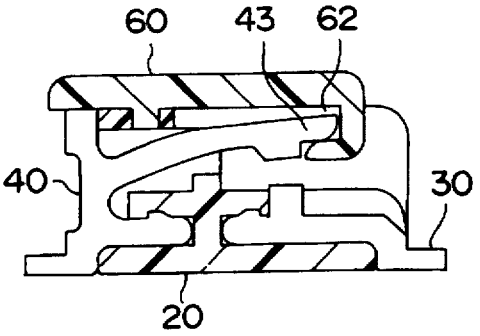
FIG. 8 is a longitudinal partial section through the connector of FIG. 7.
Figure 9:
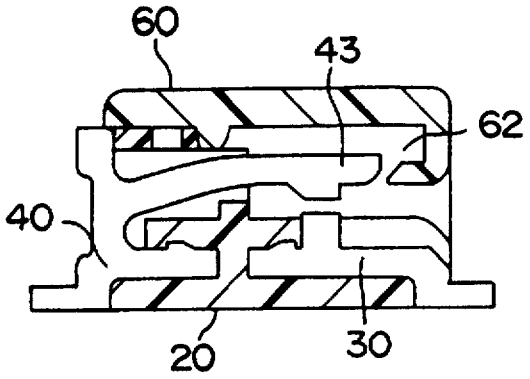
FIG. 9 PRIOR ART
FIG. 9 is similar to FIG. 8 with the cover in operative position.
Figure 10:
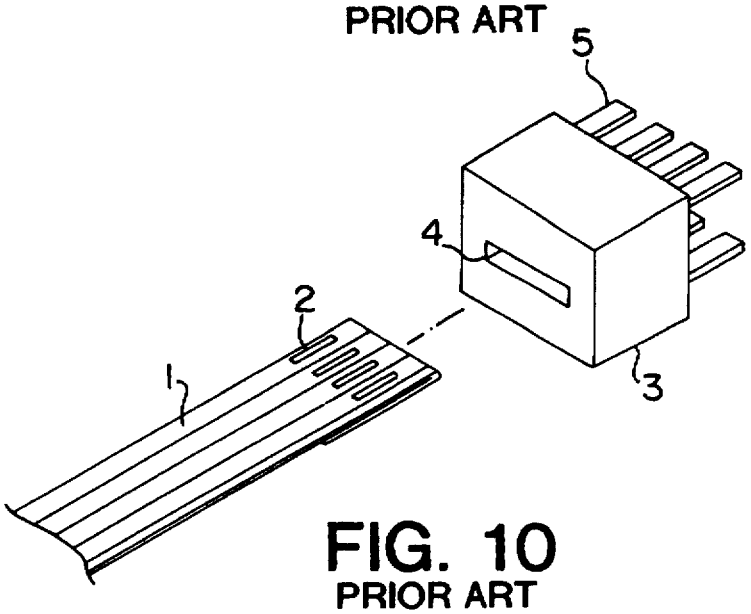
FIG. 10 PRIOR ART
FIG. 10 is a perspective view of a prior art cable connector.
Figure 11:
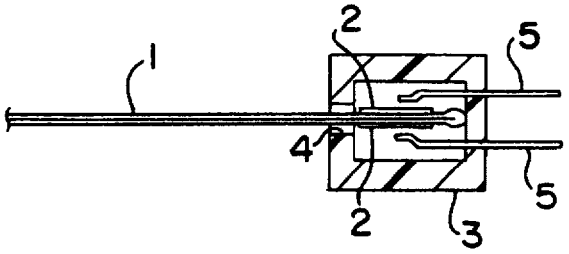
FIG. 11 PRIOR ART
FIG. 11 is a longitudinal partial cross section of the connector of FIG. 10.

A further modification of the present Invention is shown in FIGS. 7 to 9. Cover 60 is adapted to slide over casing 20 and is provided with depending wings 61 having guide holes **61*a*. Complementary projection 24 is formed on the side of casing 20. Front leads and rear leads extend outwardly from the front and rear faces of the connector, respectively. Cover 60, at its front end, is provided with a depending portion and an inturned lip. The undersurface of cover 60, the depending portion, and the inturned lip form cavity 62. As cover 60 slides onto casing 20, the leading edge of the lip contacts the distal end of rear terminal 40. As shown in FIG. 8, when cover 60 is in its left-most position, the lip raises terminal 40 and increases the separation between it and front terminal 30. This, in a similar manner to the previous embodiment, permits the introduction of the cable (not shown) into the connector without pressure or abrasion. Thereafter, as shown in FIG. 9, cover 40 is moved to the right and rear contact 43 is released by the lip and returns to its normal position adjacent front terminal 30**.

The present Invention, by dividing the external leads between two surfaces of the connector, provides more space therebetween and facilitates both assembly and production. Preferably, the front and rear terminals are three-pronged in shape having leads, positioning pieces, and contacts; however, this shape is not critical.

The connectors in accordance with the present Invention are well adapted to be placed on a printed circuit board and the leads readily soldered thereto. This can be accomplished (for example) by applying solder paste to the appropriate positions on the circuit board and mounting casing 20 thereon. This is followed by exposure to the appropriate atmosphere, whereby soldering is complete.

Although only a specific number of embodiments of the present Invention have been expressly described, it is, nonetheless, to be broadly construed and not to be limited except by the character of the claims appended hereto.

What we claim is:

1. A connector for a flat cable comprising a casing having a cavity therein, said cavity extending from a front opening in a front of said casing to a rear opening in a rear of said casing, said rear opening being remote from said front opening, said cavity adopted to receive a leading end of said cable through said front opening, a plurality of flat terminals on both sides of said leading end, a plurality of front terminals complementary to said flat terminals, in said cavity, and inserted through said front opening, said front terminals adapted to contact said flat terminals on one side of said leading end, a plurality of rear terminals complementary to said flat terminals, in said cavity, and inserted through said rear opening, said rear terminals adapted to contact said flat terminals on another side of said leading end, said front terminals and said rear terminals making electrical contact with said leading end when said leading end is between said front terminals and said rear terminals, a plurality of front leads, each in electrical contact with at least one of said front terminals and extending out of said casing through said front opening, a plurality of rear leads, each in electrical contact with at least one of said rear terminals and extending out of said casing through said rear opening.

2. The connector of claim 1 wherein said front terminals have front contacts extending toward said rear and said rear terminals have rear contacts extending toward said front.

3. The connector of claim 1 comprising at least one front fixing hole in said casing, adapted to receive a front positioning piece, at least one rear fixing hole in said casing, adapted to receive a rear positioning piece, said front positioning piece affixed to one of said front terminals, and said rear positioning piece affixed to one of said rear terminals.

4. The connector of claim 1 wherein there is a plurality of front fixing holes and rear fixing holes, which is complementary to said flat terminals.

5. The connector of claim 1 comprising a retainer having a plate extending in a direction parallel to a plane of said front terminals and said rear terminals, said plate, when inserted into said cavity, in an initial position deflecting at least one of a front contact on said front terminal and a rear contact on said rear terminal, thereby to increase a distance between said front contact and said rear contact.

6. The connector of claim 5 wherein said retainer comprises a base, said plate being normal thereto.

7. The connector of claim 5 wherein said retainer is adapted to slide onto said casing as said plate is inserted into said cavity.

8. The connector of claim 5 wherein said plate is provided with a groove corresponding to said front contact or said rear contact, said groove extending through said plate and terminating before a distal end thereof whereby, as said plate is inserted into an initial position in said cavity, said distal end deflects said front contact or said rear contact, thereby increasing said distance.

9. The connector of claim 8 wherein, as said plate moves from said initial position further into said cavity to an operative position, said front contact or said rear contact passes over said distal end and passes through said groove, thereby reducing said distance to less than a thickness of said leading end.

10. The connector of claim 8 wherein said front contact or said rear contact comprises an inclined entry face adapted to be contacted by said distal end, whereby said front contact or said rear contact is deflected when said plate is in said initial position.

11. The connector of claim 8 wherein said front contact or said rear contact comprises an inclined withdrawal face adapted to be contacted by said distal end, whereby said front contact or said rear contact is deflected when said plate moves from an operative position, wherein said front contact or said rear contact passes through said groove, to said initial position.

12. The connector of claim 1 comprising a retainer of generally planar form on said casing, said retainer having a flat surface, a depending wall at a trailing edge of said flat surface, and a forwardly extending lip on said depending wall, said lip being spaced apart from said flat surface and forming a receiving portion of said cavity, a distal edge of said lip adapted to contact and deflect a front contact on said front terminal or a rear contact on said rear terminal when said edge is fully inserted into said cavity, thereby increasing a distance between said front contact and said rear contact.

13. The connector of claim 12 wherein said lip is out of contact with said front contact and said rear contact when said retainer is at least partially withdrawn from said cavity.

14. The connector of claim 5 wherein said base comprises at least one arm adapted to slide in a complementary guide groove on a wall of said casing.

15. The connector of claim 14 wherein said base comprises a pair of spaced apart arms, each adapted to slide in a complementary guide groove on opposite walls of said casing.

16. The connector of claim 15 wherein each said guide groove contains a first projection, each of said arms having a complementary detent, said detent releasably locking said retainer on said casing when said retainer is in said operative position.

17. The connector of claim 16 wherein each said guide groove contains a second projection, said detent releasably holding said retainer on said casing in said initial position.

* * * * *